US005191666A

United States Patent [19]

Corbin

[11] Patent Number: 5,191,666

[45] Date of Patent: Mar. 9, 1993

[54] DRILL ADAPTER

[76] Inventor: Linn N. Corbin, 2325 Bishop Estates Rd., Jacksonville, Fla. 32259

[21] Appl. No.: 735,041

[22] Filed: Jul. 24, 1991

[51] Int. Cl.[5] ..... B25F 1/00

[52] U.S. Cl. ..... 7/158; 7/165

[58] Field of Search ..... 7/158, 165; 408/239 A; 279/1 A, 1 B, 1 R

[56] References Cited

U.S. PATENT DOCUMENTS

| | | | |
|---|---|---|---|
| 3,023,015 | 2/1962 | Pankow | 7/165 |
| 3,484,114 | 12/1969 | Rodin | 279/1 R |
| 3,932,904 | 1/1976 | Nilsson et al. | 7/165 |
| 4,234,277 | 11/1980 | Benson et al. | 279/75 |
| 4,413,937 | 11/1983 | Gutsche | 7/158 |
| 4,749,316 | 6/1988 | Hendricks | 279/1 B |
| 4,796,319 | 1/1989 | Taft | 7/158 |

FOREIGN PATENT DOCUMENTS

| | | | |
|---|---|---|---|
| 2137912 | 10/1984 | United Kingdom | 279/1 A |

*Primary Examiner*—Roscoe V. Parker

*Attorney, Agent, or Firm*—Arthur G. Yeager

[57] ABSTRACT

An adapter to place over a drill bit and the chuck of an electric hand drill to convert it to a power screwdriver, which includes a hollow body with tapering shoulders and an elongated tubular nose having a forward socket for a screwdriver bit, and three spring biased detents to pivot into key holes in the chuck to cause the adapter to rotate with the chuck, the body being of a size to receive said chuck and drill bit completely inside the body.

20 Claims, 1 Drawing Sheet

DRILL ADAPTER

BACKGROUND OF THE INVENTION

The popularity and convenience of the electric hand drill has made it a power source for many power tools. A myriad of tools have been fitted onto a rod and thereby become attachable to the chuck of the hand drill. For example, circular saws, hole saws, gears, pumps, screwdrivers, and the like are available today powered by the hand drill motor. Rechargeable batteries have now been made that are powerful enough to drive the drill motor and thereby free the drill from the necessity of being connected to an electric power source. The desire to use power tools rather than hand tools has led to inventions for rapid conversion of bits so as to save the time of unlocking one bit from the drill chuck, removing that bit, inserting a second bit, and locking it for use. Now it is popular to employ an adapter which is locked into the chuck by tightening the chuck key and bits are attached or removed in the same manner that a wrench socket is attached and removed from the wrench handle. These types of adapters are not acceptable for quality woodworking because the drill bits are not held tightly by the adapters, and thereby produce inaccurately drilled holes. The loose connection between bit and adapter is acceptable for screw-driving but not for drilling.

The patent prior art discloses some devices for quickly converting from an accurate power drill to a power screwdriver. See, for example, U.S. Pat. Nos. 4,092,753; 4,320,544; 4,363,250; and 4,796,319. All of these except the last one are complicated devices. The last one is much simpler, but it requires a special hexagonal drill holder.

It is an object of the present invention to provide a novel drill adapter. It is another object of this invention to provide a novel tool to convert a drill to a power screwdriver by a simple snap-on adapter. Still other objects will become apparent from the more detailed description which follows.

BRIEF SUMMARY OF THE INVENTION

This invention relates to a drill adapter for rapid conversion of a drill having a chuck and a drill bit clamped therein to a power tool having a different tool bit. The adapter includes a tubular body having a rearwardly opening hollow adapted to receive a drill chuck and drill bit, the body having an elongated tubular nose extending forwardly therefrom with the forward end of the nose having a recess for receiving a tool bit therein. The body includes a plurality of equally spaced detents spring biased to extend inwardly into the hollow and to engage keyholes in a drill chuck.

In specific and preferred embodiments of this invention the tool bit is a screwdriver bit, and the detents are pivotably fingers mounted in separate slots and urged by a circumferential spring to project those fingers into the hollow of the adapter body.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features of the drill adapter of this invention are best understood by reference to the attached drawings.

Figure 1:
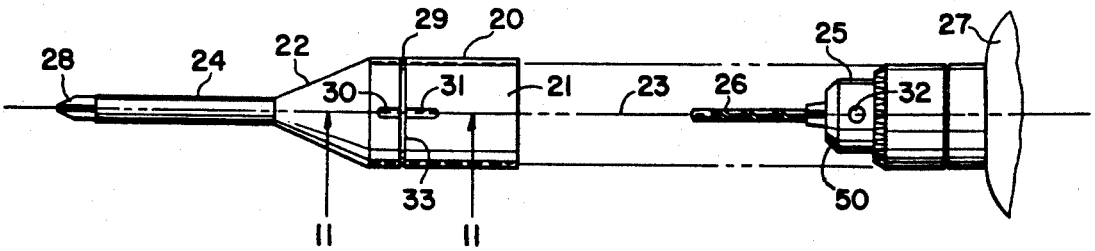
FIG. 1 is an exploded view showing how the adapter of this invention is attached to and detached from an electric hand drill with a drill bit attached.
Figure 7:
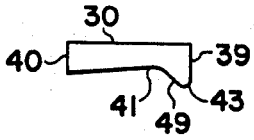
FIG. 7 is a side elevational view of a detent of the adapter of this invention.
Figure 8:
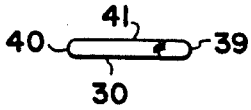
FIG. 8 is a bottom plan view of a detent of the adapter of this invention.

In FIG. 1 there is shown an electric hand drill 27 with a chuck 25, keyhole 32 and a twist drill bit 26 clamped in chuck 25 in operational engagement for drilling holes. The drill adapter of this invention has a body 20 which has a rearwardly opening internal hollow 21, sloping shoulder 22, an extension nose 24, and a screwdriver bit 28 seated in the forward end of nose 24. The adapter slides on and off drill 27 along the dotted lines connecting the two. A plurality of detents 30 fit into detent slots 31 in body 20 and are held in slots 31 by spring 29. At the rearward end of each detent 30 is a finger end 43 (see FIGS. 7–8) which catches in keyhole 32 to attach the adapter to the drill chuck 25, causing the adapter to rotate with the rotation of the chuck.

Figure 2:
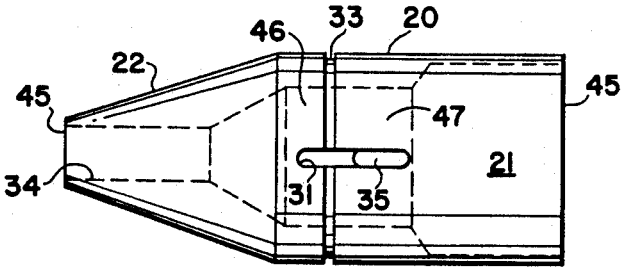
FIG. 2 is a side elevational view of the body of the adapter of this invention.
Figure 3:
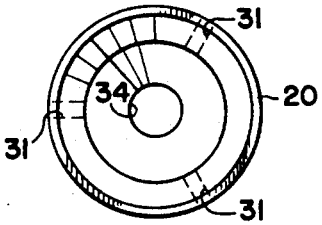
FIG. 3 is a bottom plan view of the body of the adapter of this invention.

In FIGS. 2–3 the body 20 is shown in detail as being generally hollow and cylindrical with a tapering shoulder 22.

The interior hollow 21 opens at the rearward end and is large enough to slide over the chuck 25 of drill 27. The interior hollow 21 is tapered in its mid section 46 to admit the forward clamping jaws of chuck 25. From that mid-section 46 to forward end 45 of body 20 is a bore 34 into which twist drill bit 26 enters when the adapter is coupled to the drill 27.

Around the outer perimeter of body 20 are several detent slots 31, to match keyholes 32 in drill chuck 25. Normally there are three, key holes 32 on a drill chuck 25, and so there should be three corresponding detent slots 31, equally spaced so as to match the spacing of key holes 32. Detent slots 31 are positioned at the juncture of the tapering mid-section 46 with the counterbore section 47 of interior hollow 21. Slots 31 are just deep enough to have a solid bottom in the tapering mid-section 46 and to cut through counterbore 47 to leave an open passageway 35 in the rearward portion of each slot 31. The final feature of body 20 is a circumferential groove 33 passing over the middle portion of slots 31.

Groove 33 is a seat for the wire spring 29 which biases detents 30 to catch in keyholes 32.

Figure 5:
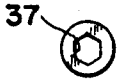
FIG. 5 is a top plan view of the extension nose of the adapter of this invention.
Figure 4:
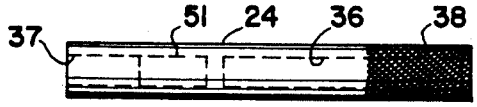
FIG. 4 is a side elevational view of the extension nose of the adapter of this invention.
Figure 6:
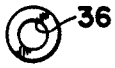
FIG. 6 is a bottom plan view of the extension nose of the adapter of this invention.

Elongated nose portion 24 is shown in FIGS. 4–6 as a separate component which is later joined to body 20 to produce the complete housing shown in FIG. 1. It is a manufacturing convenience to make body 20 separate from nose 24, and later to join the two as by welding. It is entirely possible and operable, however, to make body 20 and nose 24 as one integral article. Nose 24 is shown in FIG. 4 as a rod with a bore or recess at each end thereof. Bore 36 extends bore 34 of body 20 (FIG. 2) to provide room for drill bit 26, which may be long or short. Therefore bore 36 has any selected cross-section, such as circular as shown in FIG. 6. Bore 37 is designed to be a socket recess for a tool bit, e.g., a screwdriver bit such as 28 in FIG. 1. Therefore, bore 37 is polygonal, e.g., hexagonal as shown in FIG. 5, although other shapes, e.g., square, triangular, pentagonal can also be used. The shaping of bore 37 is made to cause the bit seated in bore 37 to turn with the turning of nose 24. Nose 24 is shown in FIG. 4 as having a knurled exterior 38 on a portion at the rearward end thereof. This is merely an alternative means for joining nose 24 to bore 34 in body 20. If nose 24 is the same size externally as bore 34 is internally, nose 24 can be pressed into bore 34, knurled section 38 being the first to enter bore 34, and friction will maintain nose 24 and body 20 together as though they were one rigid member. Alternatively, nose 24 can be welded to body 20 or joined thereto by a strong adhesive. Since it is contemplated that body 20 and nose 24 should both be metal, e.g., aluminum, welding and press-fitting, with or without the assistance of a knurled section 38, are the preferred methods of joining the two components.

Figure 9:
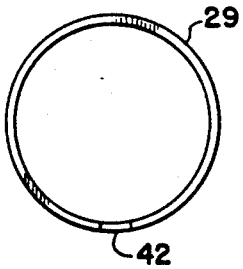
FIG. 9 is a side elevational view of the detent spring of this invention.
Figure 10:
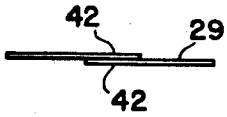
FIG. 10 is a side elevational view of the detent spring of the adapter of this invention.
Figure 11:
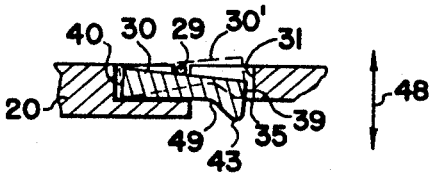
FIG. 11 is a cross-sectional view taken at 11—11 of FIG. 1.

The remainder of the drawings, FIGS. 7–11, show the location design, and operation of detents 30 and detent spring 29. Detents 30 are thin members which have a thickness slightly less than the width of slots 31. The rearward end 39 of detent 30 is wider than the forward end 40, and both ends 39 and 40 are wider than the width at waist 41. Rearward end includes a finger 43 which is positioned in slot 31 to extend inward toward hollow 21 at the passageway end 35 of slot 31. Spring 29 is placed around body 20 in groove 33 which holds detents 30 in slots 31. As shown in FIG. 11 forward end 40 of detent 30 functions as the fulcrum for detent 30 to pivot up and down in the direction of arrows 48. It will be appreciated that in the context of the drill adapter with three detents 30 around the outside of body 20, the finger tips 43 of detents 30 move radially inward and outward, as represented by arrow 48. When attaching the drill adapter of this invention to a drill one needs only to push the adapter with its open end 43 over chuck 25 until audible clicks are heard to signify that finger tips 43 have snapped inwardly into keyholes 32 to fasten the adapter to the drill chuck 25. This causes the adapter to rotate with the rotation of chuck 25. To remove the adapter, one merely pulls the adapter away from chuck 25, which causes finger tip 43 to move outwardly and retract into slot 31 releasing detents 30 from attachment to keyholes 32 and permitting removal of the adapter from the drill.

It is to be understood that while the principal use of this adapter is expected to be to convert a drill to a power screwdriver, it is useful for conversion to any other tool bit that will fit into recess 37, whether it be a screwdriver, another drill, a saw, or the like.

The detents 30 have an inclined camming surface 49 which permits ready removal of the adapter from a drill chuck 25. The drill chuck 25 has an inclined surface 50 onto which fingertips 43 move as the adapter is fitted onto chuck 25 and this opens all detents 30, into their open condition illustrated generally by broken lines 30' in FIG. 11, until the fingertips 43 latch into respective keyholes 32.

The spring 29, as shown in FIGS. 9 and 10 include overlapping end portions 42 in its relaxed condition and when not installed in slot 33, but when installed there is no overlap and the free ends are substantially juxtaposed.

A permanent magnet 51 preferably is located rearwardly of the forward recess 37 and such magnet 51 may even form the bottom 52 of the recess 37. This magnet 52 retains the non-circular tool bit 28 in the complemental shaped recess 37 to inhibit inadvertent removal thereof. The cross sectional shape of recess 37 may be any shape other than round and typically would be a hexagon or a square.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A drill adapter for rapid conversion of a drill having a chuck with equally spaced keyholes and a drill bit clamped therein to a power tool having a different tool bit, said adapter comprising an elongated tubular body having a longitudinal axis and a rearwardly opening hollow adapted to receive the chuck and the drill bit, said body having an elongated tubular nose extending forwardly therefrom with the forward end of said nose having a recess for receiving a tool bit in operational engagement, said body having a plurality of detents carried by said body and being equally spaced from each other about said hollow, each of said detents being movable radially of said longitudinal axis, said adapter including spring means engaging each of said detents for biasing said detents inwardly to extend into said hollow and to engage respective keyholes in the chuck, said detents respectively being engaged with the keyholes of the chuck and being adapted to cause rotation of said adapter with rotation of the chuck in either direction of rotation, said each of said detents having a camming surface generally aligned with said longitudinal axis, said adapter being removed from the chuck by a pulling force away from the chuck along said longitudinal axis whereby said camming surfaces move said detents against the bias of said spring means to release said detents from engagement with the keyholes in the chuck.

2. The drill adapter of claim 1 wherein said tubular nose has a rearward facing recess to receive and cover the drill bit and said forward facing recess which receives the tool bit in operational engagement.

3. The drill adapter of claim 1 wherein each said detent is positioned in a separate slot in said body and is pivotable in said slot and has a finger end which pivots from a position extending said finger end inwardly into the respective keyhole to the opposite position with said finger end retracted into said body.

4. The drill adapter of claim 3 wherein said spring means includes a circumferential spring wire around the perimeter of said body urging said finger ends inwardly toward said hollow.

5. The drill adapter of claim 4 which additionally includes a circumferential slot adapted to receive said spring wire therein.

6. The adapter of claim 1 wherein the tool bit is a screwdriver bit.

7. The drill adapter of claim 1 wherein said body includes a plurality of equally spaced slots, each detent being positioned in respective said slot of said body portion and is pivotable in said slot, each detent having a finger end pivotable from a first position extending its said finger end inwardly into respective keyhole of a drill chuck to another position with its said finger end retracted therefrom into said body portion.

8. The drill adapter of claim 7 wherein said spring means engaged with said detents urge said finger ends into said first position.

9. The drill adapter of claim 8 wherein said spring means include a circumferential spring wire around the perimeter of said body portion urging said finger ends inwardly toward said hollow.

10. The drill adapter of claim 9 further comprising a circumferential slot about said body portion and intersecting said equally spaced slots to receive said spring wire therein.

11. The drill adapter of claim 1 further comprising magnetic means located in said nose portion rearwardly of said forward recess for removably retaining the tool bit therein.

12. The drill adapter of claim 1 wherein each said detent includes an inclined camming surface to minimize the force required to detach said adapter from keyholes of a drill chuck.

13. An adapter for an electric hand drill for rapid conversion of a drill having a chuck with equally spaced keyholes and with a drill bit attached to a drill with screwdriver bit attached, said adapter comprising a hollow bullet-shaped member having a body with a rearwardly opening base, a tapered shoulder forward of said base, and a tubular nose extending forwardly of said shoulder, said member being adapted to receive inwardly thereof the chuck with drill bit attached, said body including adjacent said shoulder three detents with tips equally spaced from each other and about said rearwardly opening base adapted to seat in respective keyholes of the chuck, said adapter including spring means to bias said tips toward seating in respective keyholes, and said tubular nose having a recess at its forward end adapted to receive a screwdriver bit in operational position.

14. The adapter of claim 13 wherein said spring means is provided by a circumferential wire loop spring encircling said body in contact with said detents urging them inwardly.

15. The adapter of claim 14 wherein each said detent has a keyhole engaging finger pivotable inwardly and outwardly, respectively, toward and away from the chuck.

16. The adapter of claim 13 wherein said body includes three equally spaced longitudinally slotted passageways piercing said body, and providing seats for said detents.

17. A drill adapter for rapid conversion of a drill having a chuck and a drill bit clamped therein to a tool having a different tool bit, said adapter comprising an elongated tubular body portion having a longitudinal axis and a rearwardly opening hollow adapted to receive a drill chuck and drill bit, said body portion having an elongated tubular nose portion having a forward recess for receiving a tool bit in nesting engagement, said body portion having a plurality of equally spaced detents with the spacing being equal about said hollow between each adjacent pair, spring means engaging said detents to bias, said detents inwardly into said hollow and to engage respective equally spaced keyholes in a drill chuck said adapter being pushed onto a drill chuck and moved until said detents are biased into engagement with respective keyholes in a drill chuck, each said detent having a camming surface generally aligned with said longitudinal axis, said adapter being removed from a drill chuck by a pulling force thereon away from a drill chuck along said longitudinal axis whereby said camming surfaces move said detents radially outwardly of said longitudinal axis against the bias of said spring means to release said detents from engagement with keyholes of a drill chuck.

18. The drill adapter of claim 17 wherein said tubular nose portion has a rearward facing recess to receive and cover a drill bit and said forward facing recess removably retaining said tool bit therein.

19. The drill adapter of claim 18 wherein said forward facing recess is of a non-round cross-sectional shape and said tool bit is elongated and includes opposite end portions, one of said end portions having a complemental shape to said shape of said forward facing recess.

20. The drill adapter of claim 19 wherein another of said end portions of said tool bit is in the shape of a screwdriver to mate with a complemental opening on a screw to be driven by said tool.

* * * * *